US006199726B1

(12) United States Patent
Cardwell, III et al.

(10) Patent No.: US 6,199,726 B1
(45) Date of Patent: Mar. 13, 2001

(54) CHEMICAL IRRITANT DISPENSER

(75) Inventors: Walter Wilcox Cardwell, III; Stephen Andrew Stickel, both of Austin, TX (US)

(73) Assignee: Vermillion Corporation, Austin, TX (US)

( * ) Notice: Subject to any disclaimer, the term of this patent is extended or adjusted under 35 U.S.C. 154(b) by 0 days.

(21) Appl. No.: 09/309,990

(22) Filed: May 11, 1999

(51) Int. Cl.[7] ..... B65D 83/00

(52) U.S. Cl. ..... 222/402.11; 222/402.21; 222/325; 222/183

(58) Field of Search ..... 222/23, 153.11, 222/183, 402.1, 402.11, 402.21, 325, 402.15

(56) References Cited

U.S. PATENT DOCUMENTS

| | | | | |
|---|---|---|---|---|
| 3,385,601 | | 5/1968 | Black . | |
| 3,602,399 | * | 8/1971 | Litman | 222/153.11 |
| 3,734,353 | * | 5/1973 | McIlhenny | 222/153.11 |
| 4,241,850 | * | 12/1980 | Speer | 222/325 |
| 4,417,673 | * | 11/1983 | Hancook | 222/153.11 |
| 4,434,914 | | 3/1984 | Meshberg . | |
| 4,446,990 | | 5/1984 | Stevenson et al. . | |
| 5,169,039 | | 12/1992 | Kay et al. . | |
| 5,219,096 | | 6/1993 | Wing . | |
| 5,255,823 | | 10/1993 | Tichy et al. . | |
| 5,310,086 | | 5/1994 | Julinot . | |
| 5,458,263 | * | 10/1995 | Ciammitti et al. | 222/183 |
| 5,509,581 | | 4/1996 | Parsons . | |
| 5,556,003 | | 9/1996 | Johnson et al. . | |
| 5,570,817 | | 11/1996 | Anderson et al. . | |
| 5,673,436 | | 10/1997 | Piper . | |
| 5,673,819 | | 10/1997 | Brunswig . | |
| 5,687,886 | * | 11/1997 | Bolton | 222/325 |
| 5,829,643 | | 11/1998 | Isabella . | |
| 5,842,602 | | 12/1998 | Pierpoint . | |
| 5,859,588 | | 1/1999 | Malone et al. . | |
| 5,865,348 | | 2/1999 | Harding . | |

FOREIGN PATENT DOCUMENTS

| | | |
|---|---|---|
| 1057353 | 2/1967 | (GB) . |
| 2282905A | 4/1995 | (GB) . |
| WO 81/00997 | 4/1981 | (WO) . |

* cited by examiner

*Primary Examiner*—Kevin Shaver
*Assistant Examiner*—Thach H Bui
(74) *Attorney, Agent, or Firm*—Bracewell & Patterson, L.L.P.

(57) ABSTRACT

According to the present invention, a dispenser for dispensing a substance from a pressurized canister having a nozzle selectively operable to control release of the substance is provided. The dispenser includes an elongate housing for a pressurized canister, where the housing includes a proximal end, a distal end, and a sidewall. The distal end of the housing has an aperture formed therein, and the sidewall has an opening formed therein. An actuator, which is movable at least axially forward toward the distal end and axially backward toward the proximate end, extends within the elongate housing through the opening and cooperates with a nozzle of the pressurized canister. To operate the dispenser, the actuator is moved to an axially forward firing position in which the actuator causes the nozzle to operate, thereby releasing the substance from the pressurized canister through the aperture in a substantially axial direction.

36 Claims, 5 Drawing Sheets

CHEMICAL IRRITANT DISPENSER

BACKGROUND OF THE INVENTION

1. Technical Field

The present invention relates in general to a self-defense device and in particular to chemical irritant dispenser suitable for self-defense. Still more particularly, the present invention relates to a hand-held chemical irritant dispenser that is easily oriented, aimed, and actuated in crisis situations.

2. Description of the Related Art

Crimes against persons, while a fact of life, are not unavoidable. Proper preparation and the exercise of caution can greatly diminish the probability that an individual will be victimized. In particular, the availability and use of self-defense devices have been demonstrated to be strong deterrents to and defenses against crimes against persons.

Perhaps the best known and most widely marketed non-lethal self-defense devices are chemical irritant dispensers that, when actuated, release an aerosol chemical irritant such as MACE® or pepper spray. Conventional chemical irritant dispensers of this sort typically comprise an elongate cylindrical housing storing an aerosol chemical irritant, a button surmounting one end of the housing that is depressed to release the chemical irritant, and an aperture in the housing through which the chemical irritant is propelled in a radial direction from the cylindrical housing. As a consequence of this construction, these conventional chemical irritant dispensers are held in a vertical position when deployed and are actuated by downward motion of the index finger of the user, much like a common aerosol can.

Conventional chemical irritant dispensers like those described above are subject to a number of shortcomings that reduce their effectiveness. First, conventional chemical irritant dispensers have in the past tended to be unsightly and bulky (e.g., 6 inches (15.24 cm) long and 1 inch (2.54 cm) in diameter). Such large dimensions make carrying the chemical irritant dispenser in a handbag or garment pocket inconvenient, and the unsightly appearance of conventional dispensers has made users reluctant to carry one on a regular basis. Obviously, the utility of a chemical irritant dispenser is vitiated if it is unavailable when needed to fend off a would-be assailant.

Second, conventional chemical irritant dispenser are difficult to actuate under duress due to the awkward safety devices that are often provided to prevent accidental discharge. For vertically-oriented chemical irritant dispensers with top-located actuator buttons, the safety device typically takes the form of a plastic or leather strap covering the actuator button and/or obstructions to the downward travel of the actuator button that require the actuator button to be rotated before it is depressed. Such elaborate safety measures may be desirable when the dispenser is not being used in order to prevent accidental discharge, but present a significant hurdle to rapid use of the dispenser. The difficulty of quickly disengaging such safety devices and actuating a vertically-oriented chemical irritant dispenser was recognized by U.S. Pat. No. 5,509,581 to Parsons, which described a chemical irritant dispenser having a thumb-operated swiveling safety lock. However, actuating Parsons' chemical irritant dispenser still requires two distinct movements of the thumb—rotation of the swiveling safety lock and then depression of the actuator button—which require significant dexterity and are difficult to accomplish while under duress.

A third drawback of conventional chemical irritant dispensers is the difficulty in aiming them. As also noted by Parsons, vertically-oriented chemical irritant dispensers are difficult to orient and aim. As a result, when under stress, an individual may improperly orient the aperture of the dispenser, missing an assailant and possibly even spraying himself or herself. Parsons attempts to address this problem by providing a chemical irritant dispenser that intended to be held in the palm of the hand, with the fingers curled around the cylindrical housing and the thumb axially depressing an actuator button located at one end of the housing. This hand position naturally tends to cause the user to actuate the dispenser with his or her upper arm approximately parallel with the ground and forearm substantially vertical, sighting along the length of the housing. This body position is not instinctive, does not provide a broad range of firing positions due to the physiology of the arm and hand in that position, and therefore does not adequately address the shortcomings of conventional vertically-actuated chemical irritant dispensers. Moreover, both Parsons' dispenser and conventional vertically-oriented dispensers encourage firing positions close to the user's face and/or eyes in order to comfortably actuate and aim the dispensers. Needless to say, it is preferably for the user to release the chemical irritant as far away as possible from the user's face.

To address and overcome the foregoing and additional shortcomings in the prior art, the present invention provides an improved chemical irritant dispenser that is compact, easy to actuate, and can be quickly, comfortably, and accurately aimed under duress in an instinctive manner and body position.

SUMMARY OF THE INVENTION

According to the present invention, a dispenser for dispensing a substance from a pressurized canister having a nozzle selectively operable to control release of the substance is provided. The dispenser includes an elongate housing for a pressurized canister, where the housing includes a proximal end, a distal end, and a sidewall. The distal end of the housing has an aperture formed therein, and the sidewall has an opening formed therein. An actuator, which is movable at least axially forward toward the distal end and axially backward toward the proximate end, extends within the elongate housing through the opening and cooperates with a nozzle of the pressurized canister. To operate the dispenser, the actuator is moved to an axially forward firing position in which the actuator causes the nozzle to operate, thereby releasing the substance from the pressurized canister through the aperture in a substantially axial direction.

In one preferred embodiment of the present invention, the actuator is also movable, at the axially forward firing position, radially inward and radially outward. Moving the actuator radially inward at the axially forward firing position causes the nozzle to operate and the substance to be released. The dispenser may also include a biasing mechanism that urges the actuator axially backward, and preferably urges the actuator both axially backward and radially outward. In one preferred embodiment, the biasing mechanism is implemented as a substantially L-shaped spring including first and second legs. The outer end of the first leg is attached to the actuator, and the outer end of second leg is retained substantially stationary with respect to the pressurized canister. The second leg has an opening through which the nozzle of the pressurized canister extends. With this arrangement, the outer end of the first leg can flex toward and pivot about the outer end of the second leg to permit at least one of the actuator and the substantially L-shaped spring to contact the nozzle, diverting the nozzle from axial alignment with the canister and releasing the substance from the canister.

All objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF ILLUSTRATIVE EMBODIMENT

Figure 1:
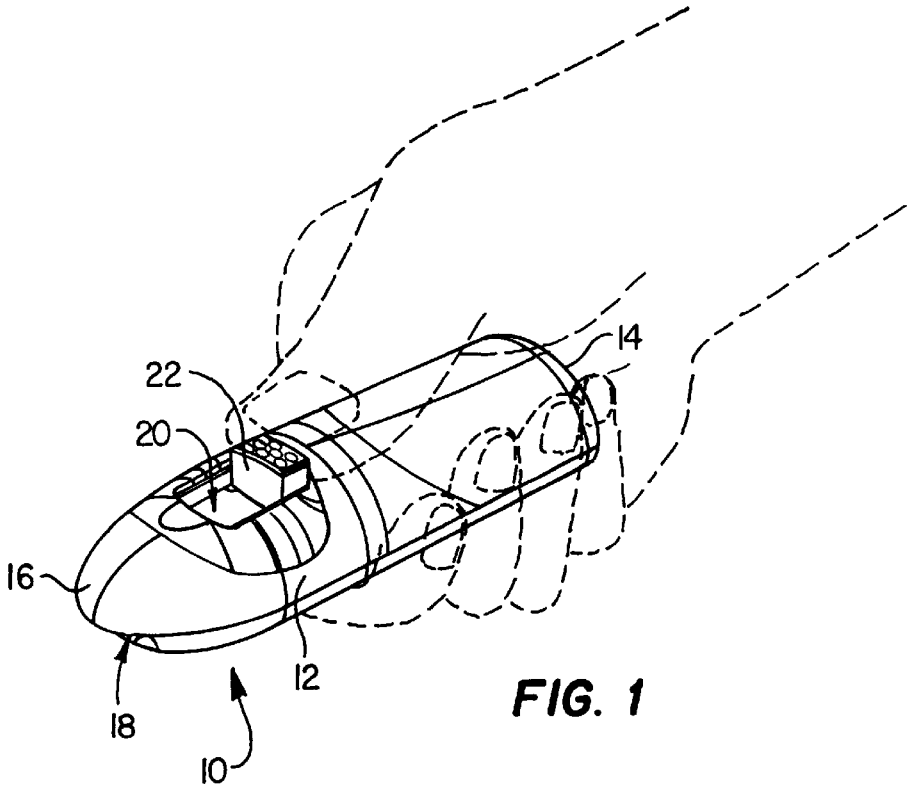
FIG. 1 depicts a perspective view of a hand-held chemical irritant dispenser in accordance the present invention.

With reference now to the figures and in particular with reference to FIG. 1, there is depicted a perspective view of an illustrative embodiment of a hand-held chemical irritant dispenser in accordance the present invention. As shown, chemical irritant dispenser 10 includes an elongate housing 12 having a long axis extending between a proximal end 14 and a distal end 16. Elongate housing 12 has a generally elliptical radial cross-section, with the longer elliptical axis being generally horizontal and the shorter elliptical axis being generally vertical in the view shown in FIG. 1. Although the dimensions of elongate housing 12 are a matter of design choice, it is preferred that the long axis of elongate housing 12 have a length in the range of approximately 4–15 cm. More particularly, it is preferred that the long axis of elongate housing 12 have a length in the range of 7–11 cm.

Elongate housing 12 defines an interior volume that is sized to receive and enclose a pressurized canister containing a chemical irritant to be dispensed, as described in greater detail below. The pressurized canister includes a nozzle that is aligned, at least during dispensing of the chemical irritant, with an aperture 18 (better seen in FIG. 2B) in distal end 16. Intermediate proximal end 14 and distal end 16, a slot 20 is formed in the sidewall of elongate housing 12. An actuator 22, which is movable at least axially backward toward the proximate end 14 and axially forward toward distal end 16, extends within slot 20 and cooperates with the valve controlling release of the chemical irritant from the canister. In this manner, the chemical irritant is projected from the canister through aperture 18 in a substantially axial direction when actuator 22 is moved to an axially forward firing position.

The location of aperture 18 and the forward-directed firing motion of actuator 22 (i.e., toward distal end 16) instinctively suggest the deployment of chemical irritant dispenser 10 as shown in FIG. 1. That is, chemical irritant dispenser 10 is intended to be cradled by the fingers of a human hand, with the thumb being utilized to manipulate actuator 22. This combination of dispenser orientation and firing motion has numerous advantages over the prior art. In particular, accuracy in aiming the chemical irritant projected from chemical irritant dispenser 10 is improved over conventional vertically-deployed dispensers in that aiming aperture 18 by the direction in which a user's thumb is pointing is a rapid, instinctive motion promoted by the design of chemical irritant dispenser 10. In addition, because chemical irritant dispenser 10 must be held in the proper orientation in order to move actuator 22 into its axially forward firing position (i.e., a forward motion with the thumb will not move actuator 22 if chemical irritant dispenser 10 is held with aperture 18 toward the user), the probability that a user under duress will inadvertently spray himself or herself with chemical irritant is greatly diminished.

Upon reference to the foregoing, it should be understood that the general principles of chemical irritant dispenser design and use discussed above can be realized in a number of different dispenser embodiments employing differing canister designs and firing mechanisms. Such embodiments include those in which moving actuator 22 in turn moves a canister housed within the dispenser, driving a nozzle of the canister into an obstruction and opening a valve (e.g., a reciprocating valve) of the canister. In other dispenser embodiments, the canister itself remains stationary within the dispenser and movement of the actuator causes operation of the canister nozzle. An example of this second type of embodiment is shown in FIG. 2A.

Figures 2A, 2C:
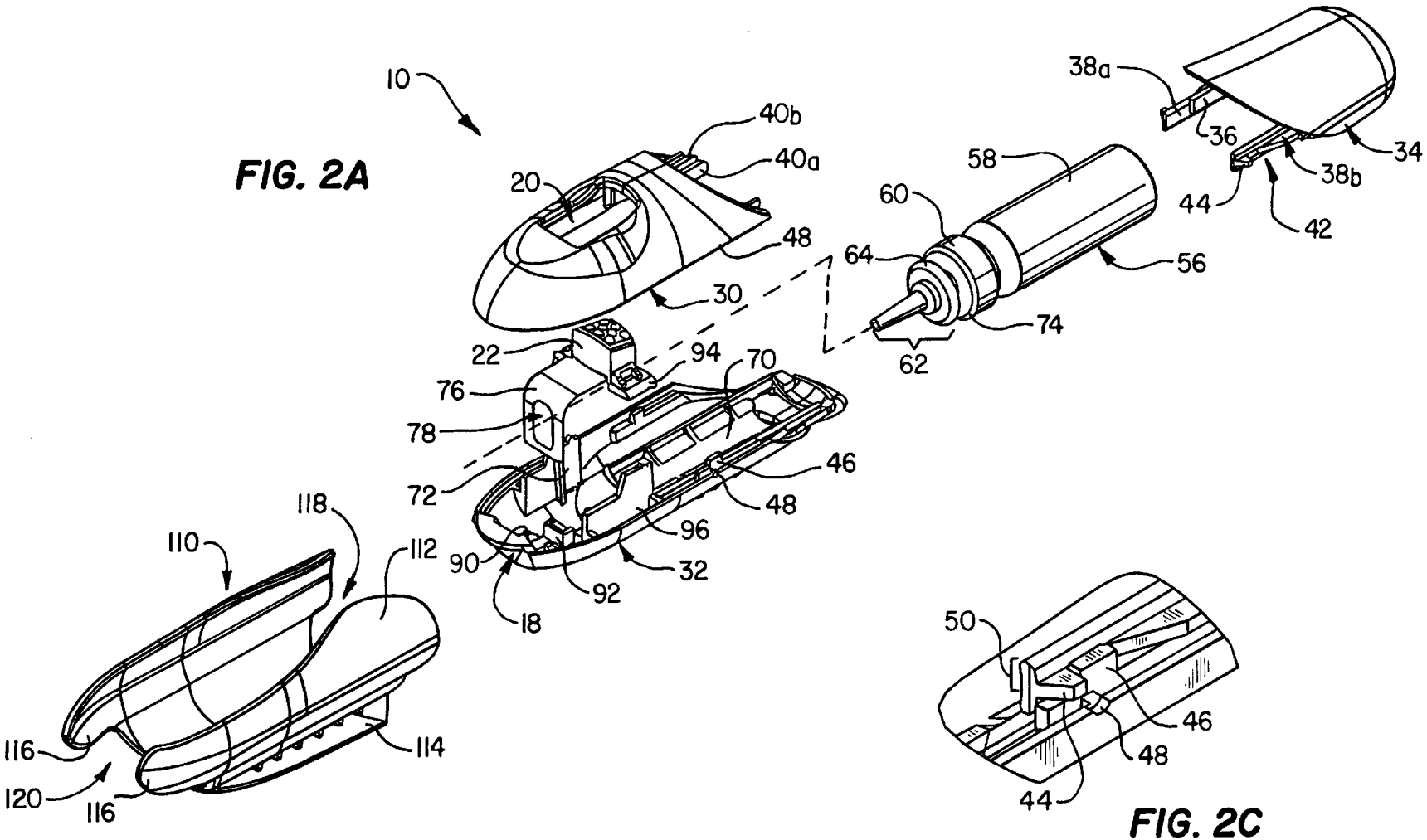
FIGS. 2A and 2B respectively illustrate exploded top and bottom views of an illustrative embodiment of the chemical irritant dispenser shown in FIG. 1 together with a holster and canister.
FIG. 2C is an enlarged view of a detent and notch of the removable proximate end piece of the chemical irritant dispenser interlocked with a vertical protrusion of the bottom piece of the chemical irritant dispenser.

Referring now to FIG. 2A, there is illustrated an exploded top view of an illustrative embodiment of the chemical irritant dispenser shown in FIG. 1 together with a holster and pressurized canister containing a chemical irritant. In the depicted illustrative embodiment elongate housing 12 is formed by three pieces: a top piece 30 and bottom piece 32, which together form a main body of elongate housing 12, and a selectively removable proximate end piece 34. All three of these pieces are preferably molded, machined, or otherwise formed of a conventional rigid plastic; however, pieces 30–34 may alternatively be formed of metal or other suitable material. Top piece 30 and bottom piece 32 are intended to be permanently bonded to each other, for example, by suitable epoxy, sonic welding, or other means. As indicated, proximate end piece 34 is not intended to be permanently bonded to the main body of elongate housing 12, but is selectively removable in order to permit the insertion and removal of a disposable canister 36 from the interior volume of elongate housing 12.

Figure 2B:
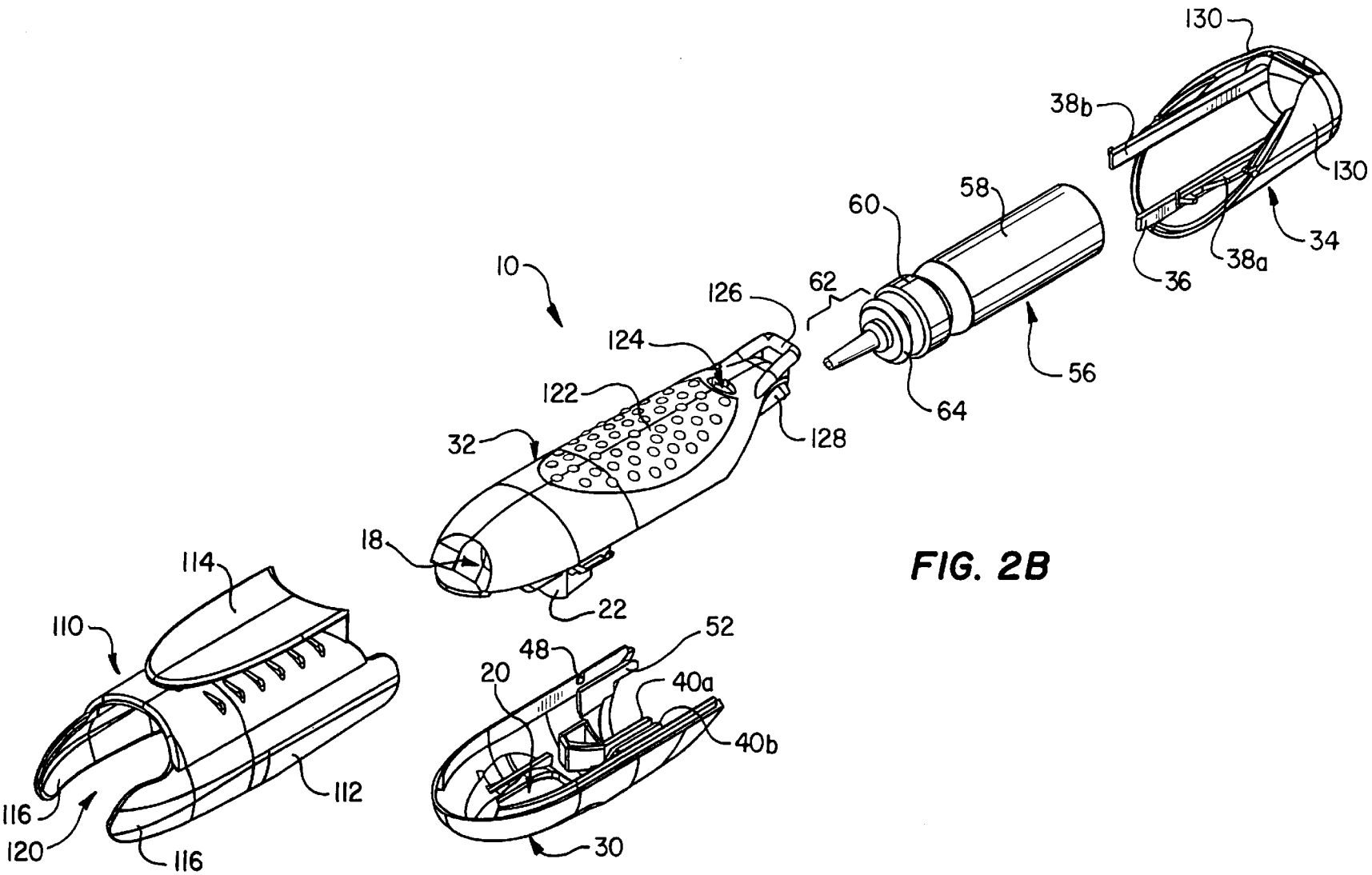

When elongate housing 12 is completely assembled, a snug fit is achieved between proximate end piece 34 and each of top piece 30 and bottom piece 32 through the cooperation of a number of design elements. First, extension 36, which is disposed at a top center of the proximate end piece 34, is received between corresponding spaced-apart extensions 40*a* and 40*b* forming a portion of top piece 30. In addition, as best shown in FIG. 2C, a detent 44 and notch 42 in each of extensions 38*a* and 38*b* interlock with a respective vertical protrusion 46 formed as a part of bottom piece 32. As can further be seen by reference to FIGS. 2B and 2C, the upward extending portion 50 of each extension 38 is also received in a slot defined by a sidewall and a rail 52 of top piece 30. As is illustrated in FIG. 2B, the fit of proximate end piece 34 with the main body of elongate housing 12 is also enhanced by a pair of wings 128 formed at the proximate end of bottom piece 32 that are received within corresponding wings 130 of proximate end piece 34. The combination of these elements ensures that proximate end piece 34 can securely (yet removably) be attached to the main body of elongate housing 10 with minimum play therebetween.

Referring back to FIG. 2A, if proximate end piece 34 is formed of sufficiently flexible plastic, proximate end piece 34 may be removed simply by inwardly deforming one or both extensions 38*a* and 38*b* by manual pressure exerted on the external sidewall of elongate housing 12. Alternatively, or in addition, corresponding arcuate surfaces 48 can be formed on the edges of top piece 30 and bottom piece 32 on at least one side of elongate housing 12 to define a release opening permitting external access to a detent 44. Thus, proximate end piece 34 may be removed from the main body of elongate housing 12 by inserting a small object (e.g., the point of a pen) through a release opening in elongate housing 12 and applying sufficient inward force on the detent 44 to deform its extension 38 enough to permit the detent 44 to be released from the interlocking vertical protrusion 46. Freeing one detent 44 from its interlocking vertical protrusion 46 in this manner would generally be sufficient to enable removal of proximate end piece 34 with moderate backward force. The release opening defined by arcuate surfaces 48 can also be utilized to further secure proximate end piece 34 to the main body through the insertion of a pin or screw to retain the adjacent extension 38.

As shown in FIG. 2A, canister 56, which can be formed of aluminum or other suitable material, includes a cylindrical portion 58, a valve portion 60, and a nozzle 62 having a enlarged diameter portion 64. Valve portion 60 preferably contains a spring-loaded toggle valve that is closed when nozzle 62 is axially aligned with cylindrical portion 58 and is open when nozzle 62 is diverted from axial alignment with cylindrical portion 58. The spring-action of the toggle valve urges nozzle 62 into axial alignment with cylindrical portion 58. Cylindrical portion 58 contains a selected substance under sufficient pressure such that the substance is forcefully projected from chemical irritant dispenser 10 when actuator 22 is actuated to open the toggle valve within valve portion 40. In a preferred embodiment, chemical irritant dispenser 10 is packaged together with multiple canisters 36, at least one of which is a "practice" or training canister containing water or other a non-irritating substance and at least one of which contains a chemical irritant such as pepper spray or a mixture containing oleocapsicum. In this manner, a user is safely able to familiarize himself or herself with the operation and firing characteristics of chemical irritant dispenser 10 prior to use under duress. As discussed further below, such "practice" or training canisters can be distinguished from those containing a chemical irritant by color-coding all or a portion of canisters 36 (e.g., blue for a "practice" canister and red for a canister containing a chemical irritant).

A canister 56 loaded into elongate housing 12 rests within a cradle 70 molded into bottom piece 32. Canister 56 remains substantially stationary within cradle 70, with its forward travel (i.e., toward distal end 16) constrained by molded stops such as a pair of posts 72 (only one of which can be seen) that engage the shoulder 74 of valve portion 60. The backward travel (i.e., toward proximal end 14) of canister 56 is inhibited by interference fit within the interior surfaces of elongate housing 12. With canister 56 installed in this manner, nozzle 62 extends through an opening 78 in L-shaped spring 76.

Figure 3:
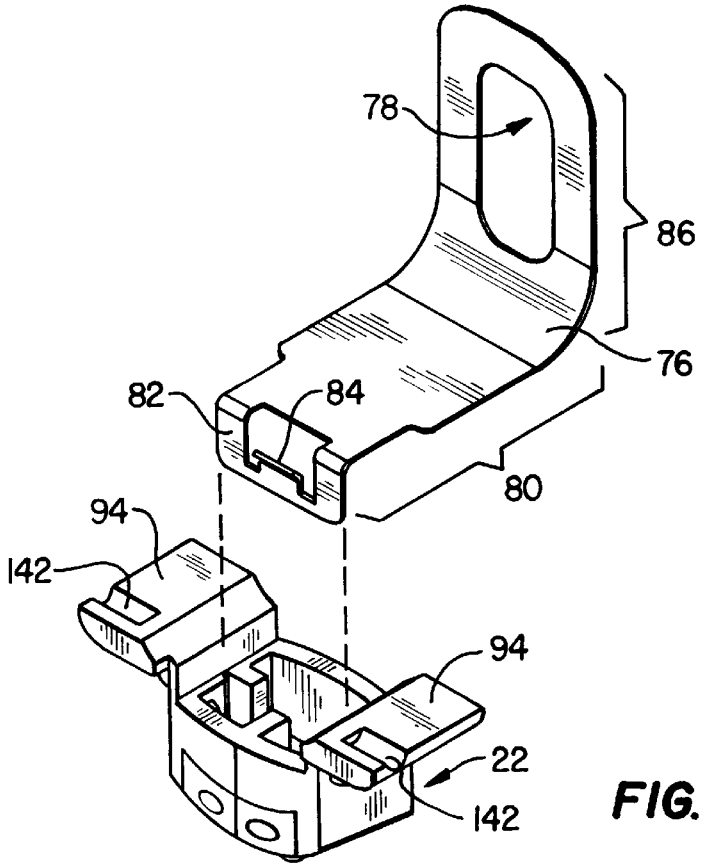
FIG. 3 is a more detailed view of the firing mechanism of the chemical irritant dispenser shown in FIGS. 2A and 2B.

L-shaped spring 76, which together with actuator 22 forms the firing mechanism of chemical irritant dispenser 10, is preferably formed of a highly flexible material having no (or very low) memory such as beryllium copper. L-shaped spring 76 has a first leg 80 to which actuator 22 is attached and a second leg 86 in which opening 78 is formed. Actuator 22 is attached to first leg 80, for example, by interference fit, spring tension, or suitable epoxy. One preferred method of attaching actuator 22 to L-shaped spring 76 is depicted in FIG. 3, which illustrates first leg 80 terminating with an attachment tab 82 having an integral spring member 84. As indicated in FIG. 3 with dashed lines, attachment tab 82 is received within a corresponding slot in the interior of actuator 22, and integral spring member 84 engages an interior surface of actuator 22, thereby removably attaching actuator 22 to first leg 80 of L-shaped spring 76.

Referring again to FIG. 2A, when chemical irritant dispenser 10 is fully assembled, the terminating end of second leg 86 is captured between one or more ramps 90 and a wall 92 integral to bottom piece 32. Thus, the terminating end of second leg 86 is retained substantially stationary to a canister 56 installed in chemical irritant dispenser 10. In addition, wings 94 integral to actuator 22 rest on respective supports 96 integral to bottom piece 32 and extending into the interior of elongate housing 12. Supports 96 preferably have a length at least co-extensive with the axial distance actuator 22 is permitted to travel by the axial dimension of slot 20 in top piece 30. In this manner, the profile of supports 96 determines the range of radially inward motion the actuator 22 is permitted at each point along its axial range of motion.

Figure 4A:
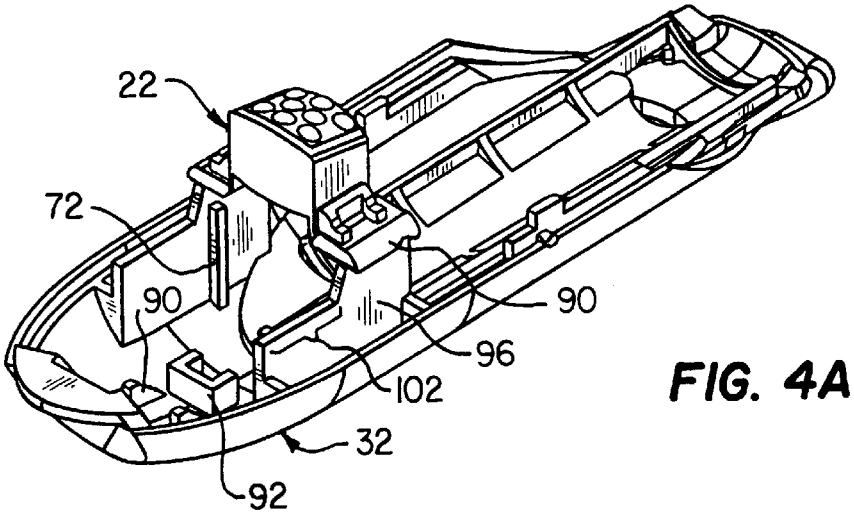
FIGS. 4A and 4B respectively illustrate the actuator of the chemical irritant dispenser in an axially backward safety position and an axially forward firing position.
Figure 4B:
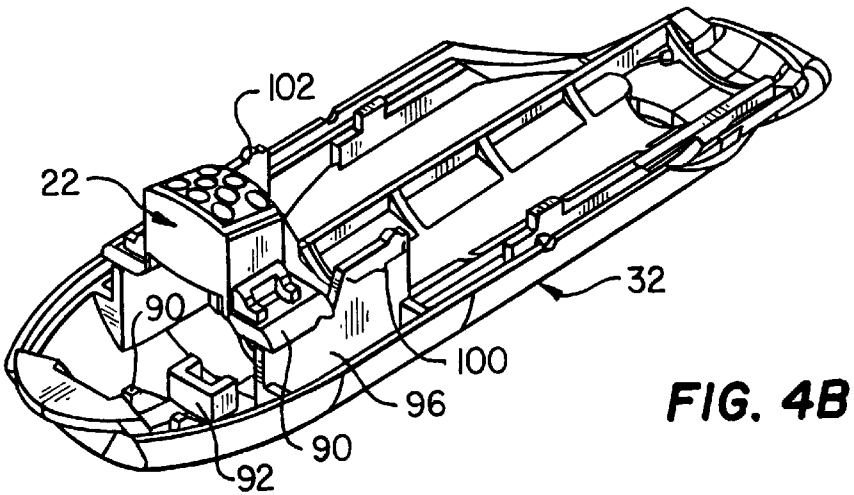

As best depicted in FIGS. 4A and 4B, the profile of each support 96 varies along its length so that each support 96 includes a higher portion 100 and a lower portion 102. The higher portions 100 of supports 96 define an axially backward safety position of actuator 22 in which movement of actuator 22 is substantially constrained to translation in an axial direction. Actuator 22 is pictured in a backward safety position in FIG. 4A. The lower portions 102 of supports 96 further define an axially forward firing position in which actuator 22 is permitted to move radially inward and outward. FIG. 4B illustrates actuator 22 in the axially forward firing position.

Referring again to FIG. 2A, chemical irritant dispenser 10 can advantageously be paired with a holster 110 to enhance the availability and accessibility of chemical irritant dispenser 10. Holster 110 comprises a sleeve portion 112 and a clip portion 114, which permits holster 110 to be worn on a belt, hooked over a garment waistband, clipped to a handbag or briefcase, etc. Sleeve portion 112 has an inner surface that is contoured to interference fit with the exterior surface of elongate housing 12. Sleeve portion 112 is highly relieved to permit access to actuator 22 and to avoid obstruction of aperture 18 when chemical irritant dispenser 10 is holstered. Thus, chemical irritant dispenser 10 may be readily deployed and fired even while retained within holster 110. It is preferred that chemical irritant dispenser 10 be easily retrievable via posterior opening 118 of holster 110 and that arms 116 defining anterior opening 120 have appropriate flexibility and spacing to securely retain chemical irritant dispenser 10 within holster 110 under normal carrying conditions but to permit removal of chemical irritant dispenser 10 from holster 110 via anterior opening 120 if significant yet non-destructive manual force is applied, for example, in a crisis situation. Holster 110 can advantageously be formed of a photo-luminescent material, for example, a plastic containing zinc sulfide or strontium aluminate, in order to improve visibility of holster 110 (and therefore chemical irritant dispenser 10) in dark conditions or when stored inside a handbag or other container. The accessibility of holster 110 can further be enhanced by applying adhesive-backed hook-and-loop (e.g., VELCRO®) material to the exterior surface of clip portion 114, which permits holster 110 to be temporarily attached to another surface such as an automobile dashboard.

With reference now to FIG. 2B, there is depicted an exploded bottom view of chemical irritant dispenser 10 from FIG. 2A. In addition to many of the features described hereinabove, FIG. 2B illustrates a textured gripping region 122 on the exterior surface of bottom piece 32. Textured gripping region 122, which is preferably formed of rubber or other material having a high coefficient of friction, serves a number of purposes, including enhancing a user's grip, serving as a tactile register that encourages optimal finger positioning, and reducing unintended movement of chemical irritant dispenser 10 within holster 110 (e.g., when chemical irritant dispenser 10 is holstered and the user is running or walking with holster 110 clipped to his or her waistband). As shown in FIGS. 2A and 3, a similar textured material may also advantageously be applied to the top surface and at least a portion of the proximate side of actuator 22 to facilitate digital manipulation of actuator 22.

Referring again to FIG. 2B, bottom piece 32 also has a view port 124 formed therethrough. View port 124 enables a user to readily determine if a canister 56 is loaded into chemical irritant dispenser 10 and, if so, to determine the contents of the canister 56 by the color-coding scheme described above. Bottom piece 32 further includes an integral attachment loop 126 to permit a key ring, wrist strap, or other accessory to be attached to chemical irritant dispenser 10. Attachment loop 126 is located at proximate end 14 of elongate housing 12 in order to prevent interference of an attached accessory with deployment and use of chemical irritant dispenser 10.

Figure 5A:
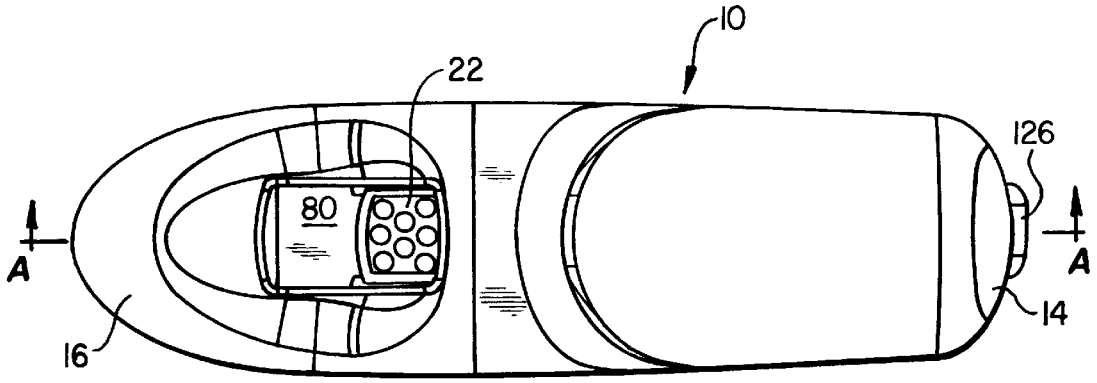
FIG. 5A depicts a top plan view of the chemical irritant dispenser shown in FIGS. 2A and 2B.
Figure 5B:
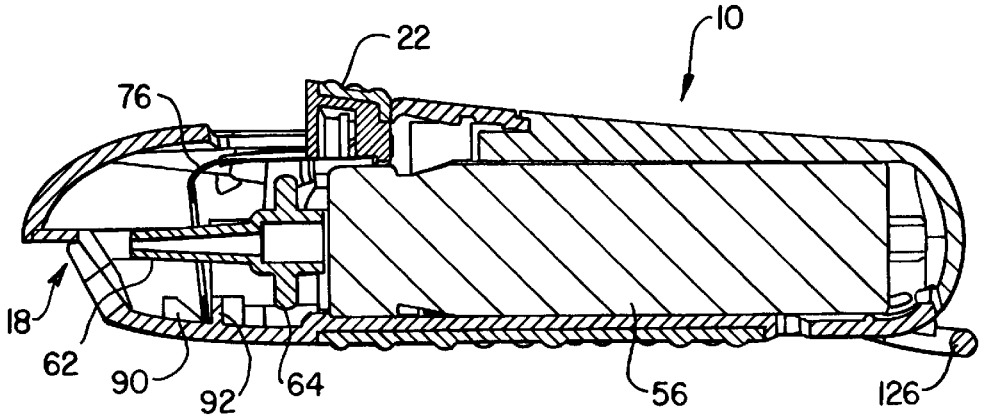
FIGS. 5B and 5C are cross-sectional views of the chemical irritant dispenser shown in FIGS. 2A and 2B in which the actuator is in the axially backward safety position and the axially forward firing position, respectively.
Figure 5C:
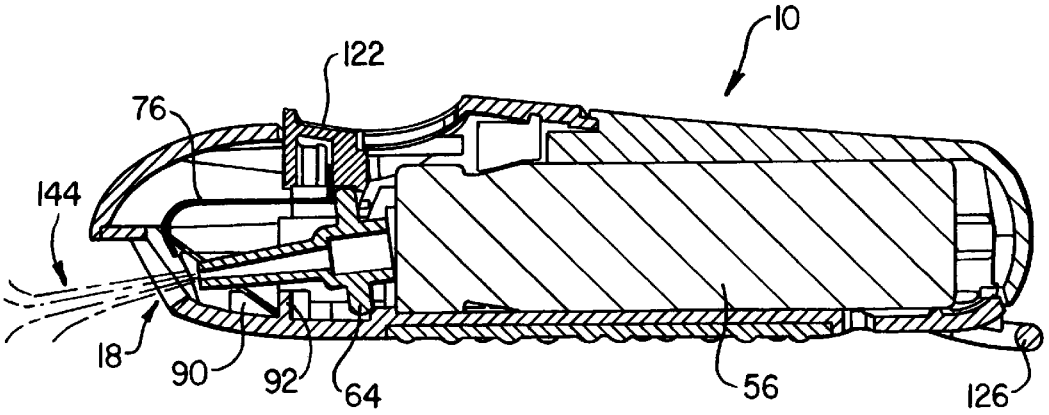

Referring now to FIG. 5A, there is depicted a top plan view of chemical irritant dispenser 10 illustrating a line A—A along which the cross-sectional views shown in FIGS. 5B and 5C are taken. FIG. 5B illustrates a cross-sectional view of chemical irritant dispenser 10 in which actuator 22 is located in an axially backward safety position. As discussed above, when actuator 22 is in an axially backward safety position, actuator 22 is constrained from substantial radially inward movement, and nozzle 62 remains in axial alignment with canister 56. Thus, the toggle valve of canister 56 is closed, and the substance stored under pressure within canister 56 is not dispensed. As shown in FIGS. 5A and 5B, with actuator 22 in an axially backward safety position, first leg 80 of L-shaped spring 76 also advantageously blocks access to the interior of chemical irritant dispenser 10 through slot 20, thereby preventing inadvertent dispensing of the substance in canister 56 due to an object contacting nozzle 62 through slot 20.

With reference now to FIG. 5B, there is depicted a cross-sectional view of chemical irritant dispenser 10 in which actuator 22 is located in the axially forward and radially inward firing position. In order to move actuator 22 from the axially backward safety position shown in FIG. 5A to the axially forward and radially inward firing position shown in FIG. 5B, the user translates actuator 22 axially forward (i.e., toward distal end 16) against the axially backward force of L-shaped spring 76, preferably with the thumb of his or her hand. In order to provide tactile feedback to the user that actuator 22 is being moved from the axially backward safety position to the axially forward firing position, the surface of upper regions 100 of supports 96 can include a texture such as bumps 140 (shown in FIG. 4B) that provide nominal resistance to the translation of actuator 22 when mated with corresponding hollows 142 (shown in FIG. 3) formed into wings 94 of actuator 22. Of course, in an alternative embodiment, the location of the bumps and hollows can be reversed, with the "male" texture located on the underside of wings 94 and a female texture formed into the upper surface of supports 96.

After actuator 22 has been moved axially forward from its most axially backward position, substantial movement of actuator 22 radially inward is prevented as long as wings 94 of actuator 22 overlap with upper regions 100 of supports 96. However, once wings 94 have cleared upper regions 100 of supports 96, actuator 22 may selectively be driven radially inward toward the outer end of second leg 86 of L-shaped spring 76 against the radially outward force of L-shaped spring 76. Lower regions 102 of supports 96 are sufficiently different in height from upper regions 100 to permit one or both of actuator 22 and first leg 80 of L-shaped spring 76 to engage enlarged diameter portion 64 of nozzle 62. As shown in FIG. 5C, nozzle 62 may thus be diverted from axially alignment with canister 56 against the combined spring force of L-shaped spring 76 and the toggle valve spring, thereby forcing the toggle valve open and dispensing substance 144 from canister 56 as a result of the pressure differential between the ambient environment and the interior of canister 56. The maximum extent to which nozzle 62 may be diverted from axial alignment with canister 56 can be controlled by any number of factors, including the stiffness of L-shaped spring 76, the shape of ramps 90, the diameter of enlarged diameter portion 64 of nozzle 62 in relation to the interior of chemical irritant dispenser 10, and the height of lower regions 102 of supports 96. When the force applied to actuator 22 diminishes to less than the spring force of L-shaped spring 76, the radially outward and axially backward spring force of L-shaped spring 76 automatically returns actuator 22 to the axially backward safety position shown in FIG. 5B, and the spring force of the toggle valve closes the toggle valve and returns nozzle 62 to axial alignment with canister 56, as also shown in FIG. 5B.

As has been described, the present invention provides an improved dispenser that may advantageously be utilized as a chemical irritant dispenser for self-defense. The dispenser has numerous advantages over conventional chemical irritant dispensers in that the dispenser of the present invention is compact, can utilize disposable cartridges, and can be quickly deployed and fired even when loaded in its holster. In addition, the dispenser of the present invention promotes instinctive aiming and permits a user to rapidly disengage the actuator from its safety position and "fire" the dispenser with a single fluid motion that requires only minimum dexterity.

While the invention has been particularly shown and described with reference to an illustrative embodiment, it will be understood by those skilled in the art that various changes in form and detail may be made therein without departing from the spirit and scope of the invention.

What is claimed is:

1. A dispenser for dispensing a substance from a pressurized canister having a valve selectively operable to control release of the substance, said dispenser comprising:

an elongate housing for a pressurized canister, said elongate housing having a proximal end, a distal end, and a sidewall, wherein said distal end has an aperture formed therein and said sidewall has an opening formed therein; and an actuator that extends within said elongate housing through said opening, said actuator being movable at least axially forward toward said distal end and axially backward toward said proximate end, said actuator having an axially forward firing position in which said actuator is operatively coupled to the pressurized canister to open the valve and release the substance from the pressurized canister through the aperture in a substantially axial direction.

2. The dispenser of claim 1, said actuator further being movable, at said axially forward firing position, between a radially inward position and a radially outward position, wherein said actuator is operatively coupled to the pressurized canister to open the valve and release the substance only at the radially inward position.

3. The dispenser of claim 1, and further comprising the pressurized canister, wherein the pressurized cannister includes a nozzle and wherein the valve of the pressurized canister is opened by said actuator by diverting the nozzle from axial alignment with said pressurized canister.

4. The dispenser of claim 1, and further comprising a biasing mechanism urging said actuator at least axially backward.

5. The dispenser of claim 4, said biasing mechanism comprising a spring within said elongate housing urging said actuator both radially outward and axially backward.

6. The dispenser of claim 5, wherein said spring is formed of beryllium copper.

7. The dispenser of claim 5, said spring having a first leg and a second leg, wherein said actuator is attached to said first leg and said second leg has an opening therein through which a nozzle of the pressurized cannister extends.

8. The dispenser of claim 7, and further comprising at least one ridge integral to an interior of said elongate housing that engages an end of said second leg to retain said end of said second leg substantially stationary with respect to the pressurized canister.

9. The dispenser of claim 1, said elongate housing including at least a main body and a selectively removable proximal end piece.

10. The dispenser of claim 1, said elongate housing having an attachment loop toward said proximal end.

11. The dispenser of claim 1, wherein said elongate housing is substantially elliptical in radial cross-section, said substantially elliptical radial cross-section having a larger major axis and a smaller minor axis, wherein said actuator is disposed adjacent said minor axis at an exterior of said elongate housing.

12. The dispenser of claim 11, said elongate housing having a textured region on an exterior side opposite said actuator.

13. The dispenser of claim 1, said elongate housing having an axial length of approximately 13 centimeters or less.

14. The dispenser of claim 1, and further comprising at least one support within an interior of said elongate housing, said support having an upper surface and a length, wherein a profile of said upper surface along said length limits an extent of radial inward movement of said actuator.

15. The dispenser of claim 14, said length of said support including a safety region at which said profile prevents operation of said nozzle.

16. The dispenser of claim 14, wherein at least one of said upper surface and said actuator includes at least one protrusion providing tactile feedback regarding a position of said actuator.

17. An actuator apparatus suitable for dispensing a substance from a pressurized canister having a nozzle and a selectively operable valve that is open when the nozzle is diverted from axial alignment with said canister and closed otherwise, said actuator apparatus comprising:

a manually manipulable element; and a spring including a first leg and a second leg having an opening therein through which the nozzle of the pressurized canister can extend, wherein an outer end of said first leg is attached to said manually manipulable element and wherein an outer end of second leg is retained substantially stationary with respect to the pressurized canister, such that said outer end of said first leg can flex toward and pivot about said outer end of said second leg to permit at least one of said manually manipulable element and said spring to contact said nozzle and divert said nozzle from axial alignment with said canister to open the valve and release said substance.

18. The actuator apparatus of claim 17, wherein said spring is substantially L-shaped.

19. The actuator apparatus of claim 17, wherein said second leg defines an enclosed perimeter of said opening.

20. A dispenser, comprising:

a housing sized to enclose a pressurized canisters; and an actuator apparatus as recited in claim 17.

21. A dispenser for dispensing a substance from a pressurized canister having a nozzle and a selectively operable valve that is open when the nozzle is diverted from axial alignment with said canister and closed otherwise, said dispenser comprising:

an elongate housing for a pressurized canister, said elongate housing having a proximal end and a distal end, wherein said distal end has an aperture formed therein;

a manually manipulable element; and a spring within said elongate housing, said spring including a first leg and a second leg having an opening therein through which the nozzle of the pressurized canister can extend, wherein an outer end of said first leg is attached to said manually manipulable element and wherein an outer end of second leg is retained substantially stationary with respect to the pressurized canister, such that said outer end of said first leg can flex toward and pivot about said outer end of said second leg to permit at least one of said manually manipulable element and said spring to contact said nozzle and divert said nozzle from axial alignment with said canister to open the valve and release said substance through said aperture.

22. The dispenser of claim 21, and further comprising the pressurized canister.

23. The dispenser of claim 21, wherein said spring is substantially L-shaped.

24. The dispenser of claim 21, said elongate housing including at least a main body and a selectively removable proximal end piece.

25. The dispenser of claim 21, said elongate housing having an attachment loop toward said proximal end.

26. The dispenser of claim 21, wherein said elongate housing is substantially elliptical in radial cross-section, said substantially elliptical radial cross-section having a larger major axis and a smaller minor axis, wherein said manually manipulable element is disposed adjacent said minor axis at an exterior of said elongate housing.

27. The dispenser of claim 26, said elongate housing having a textured region on an exterior side opposite said manually manipulable element.

28. The dispenser of claim 21, said elongate housing having an axial length of less than 13 centimeters.

29. The dispenser of claim 21, and further comprising at least one ridge integral to an interior of said elongate housing that engages said outer end of said second leg to retain said outer end of said second leg substantially stationary with respect to said pressurized canister.

30. The dispenser of claim 21, and further comprising at least one sidewall within an interior of said elongate housing, said sidewall having a upper surface, a length and a profile, wherein said profile of said sidewall limits an extent of movement of said manually manipulable element and said outer end of said first leg toward said outer end of said second leg.

31. The dispenser of claim 30, said length of said sidewall including a safety region at which said profile prevents diversion of said nozzle from axial alignment with said canister.

32. The dispenser of claim 30, wherein at least one of said upper surface and said actuator includes at least one protrusion providing tactile feedback regarding a position of said actuator.

33. The dispenser of claim 9, wherein said selectively removable proximal end piece has a detent arranged to engage a surface of said main body when said selectively removable proximal end piece is assembled together with said main body.

34. The actuator apparatus of claim 17, wherein said spring is formed of beryllium copper.

35. The dispenser of claim 21, wherein said spring is formed of beryllium copper.

36. The dispenser of claim 24, wherein said selectively removable proximal end piece has a detent arranged to engage a surface of said main body when said selectively removable proximal end piece is assembled together with said main body.

* * * * *